US010797398B2

(12) United States Patent
Bellec et al.

(10) Patent No.: US 10,797,398 B2
(45) Date of Patent: Oct. 6, 2020

(54) SURFACE-WAVE ANTENNA, ANTENNA ARRAY AND USE OF AN ANTENNA OR AN ANTENNA ARRAY

(71) Applicants: TDF, Montrouge (FR); UNIVERSITE DE RENNES 1, Rennes (FR)

(72) Inventors: Mathilde Bellec, La Chapelle des Fougeretz (FR); Jean-Yves Laurent, Rennes (FR); Sébastien M. Palud, Rennes (FR); Pierre-Yves Jezequel, Thorigné-Fouillard (FR); Franck Colombel, Monfort-sur-meu (FR); Stéphane Avrillon, Rennes (FR)

(73) Assignees: UNVERSITE DE RENNES 1, Rennes (FR); TDF, Montrouge (FR)

( * ) Notice: Subject to any disclaimer, the term of this patent is extended or adjusted under 35 U.S.C. 154(b) by 233 days.

(21) Appl. No.: 15/751,080

(22) PCT Filed: Jul. 22, 2016

(86) PCT No.: PCT/FR2016/051917
§ 371 (c)(1),
(2) Date: Feb. 7, 2018

(87) PCT Pub. No.: WO2017/025675
PCT Pub. Date: Feb. 16, 2017

(65) Prior Publication Data

US 2019/0165477 A1 May 30, 2019

(30) Foreign Application Priority Data

Aug. 10, 2015 (FR) ..... 15 57654

(51) Int. Cl.
*H01Q 9/18* (2006.01)
*H01Q 1/04* (2006.01)
(Continued)

(52) U.S. Cl.
CPC ..... *H01Q 9/18* (2013.01); *H01Q 1/04* (2013.01); *H01Q 9/20* (2013.01); *H01Q 9/42* (2013.01);
(Continued)

(58) Field of Classification Search
CPC ..... H01Q 9/18; H01Q 9/20; H01Q 13/26; H01Q 21/0006; H01Q 21/08
See application file for complete search history.

(56) References Cited

U.S. PATENT DOCUMENTS

| | | | |
|---|---|---|---|
| 1,790,646 | A | 2/1931 | Alexanderson |
| 3,253,279 | A | 5/1966 | Tanner |

(Continued)

FOREIGN PATENT DOCUMENTS

| | | |
|---|---|---|
| GB | 233346 | 7/1926 |
| GB | 665736 | 1/1952 |
| WO | 02/45209 | 6/2002 |

*Primary Examiner* — Hoang V Nguyen
(74) *Attorney, Agent, or Firm* — Duane Morris LLP; Gregory M. Lefkowitz; Jason M. Nolan

(57) ABSTRACT

The invention relates to an antenna designed to emit and/or receive surface waves with a decametric, hectometric or kilometric central wavelength $\lambda_0$, characterised in that it comprises at least one horizontal wire aerial element of between $0.5\lambda_0$ and $\lambda_0$ in length, and at least three vertical wire aerial elements of the same length between $0.03\lambda_0$ and $0.1\lambda_0$, arranged in a same plane and each comprising an upper end and a lower end, said upper ends being connected to the horizontal wire aerial element, said lower ends being designed to be connected to a conducting medium having a substantially horizontal surface. The invention also relates to an antenna, an antenna array and a use of an antenna or of an antenna array.

13 Claims, 3 Drawing Sheets

Figure 1:
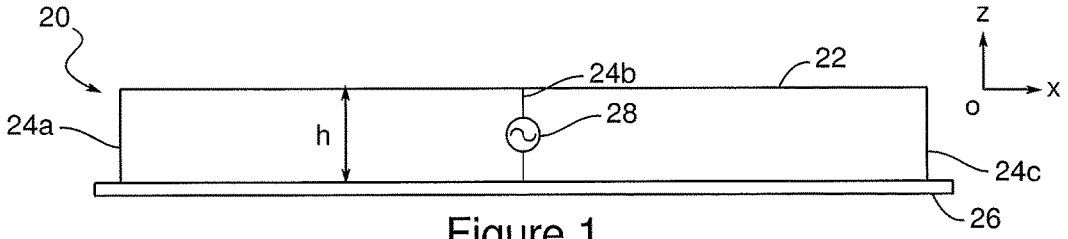

(51) Int. Cl.

| | |
|---|---|
| ***H01Q 9/44*** | (2006.01) |
| ***H01Q 9/42*** | (2006.01) |
| ***H01Q 9/20*** | (2006.01) |
| ***H01Q 13/26*** | (2006.01) |
| ***H01Q 21/00*** | (2006.01) |
| ***H01Q 21/08*** | (2006.01) |

(52) U.S. Cl.
CPC ..... *H01Q 9/44* (2013.01); *H01Q 13/26* (2013.01); *H01Q 21/0006* (2013.01); *H01Q 21/08* (2013.01)

(56) References Cited

U.S. PATENT DOCUMENTS

| | | | | |
|---|---|---|---|---|
| 5,457,470 | A * | 10/1995 | Hai | H01Q 1/3233 343/713 |
| 6,600,455 | B2 * | 7/2003 | Yamamoto | H01Q 9/42 343/826 |
| 2008/0278387 | A1 * | 11/2008 | Piole | H04B 7/02 343/703 |
| 2009/0058742 | A1 * | 3/2009 | Tsurume | H01Q 1/1271 343/713 |

* cited by examiner

SURFACE-WAVE ANTENNA, ANTENNA ARRAY AND USE OF AN ANTENNA OR AN ANTENNA ARRAY

CROSS-REFERENCE TO RELATED APPLICATIONS

This application is a § 371 national stage entry of International Application No. PCT/FR2016/051917, filed Jul. 22, 2016, which claims priority to French Patent Application No. 1557654, filed Aug. 10, 2015, the entire contents of which are incorporated herein by reference.

1. TECHNICAL SCOPE OF THE INVENTION

The invention relates to an antenna, an antenna array and a use of an antenna or of an antenna array. In particular, the invention relates to an antenna or an array of vertically and/or elliptically polarised antennas designed to emit and/or receive surface waves in a wide frequency band including in particular all or part of low, medium and high frequencies between around 30 kHz and around 30 MHz, i.e. kilometric, hectometric and decametric waves.

2. TECHNOLOGICAL BACKGROUND

Currently, large radiating towers are used to emit high power within hectometric bands. These towers have the disadvantage of being expensive, of requiring a significant security ground for their installation, and of being unattractive and indiscreet. They are not optimised for scattering using mainly surface waves.

Antennas using only a surface wave as a propagation vector are not very common. Modern surface wave antennas are whip- or biconical-type antennas that are ill-suited for such applications.

Radiating towers and generally all vertically polarised antennas, for example whip or biconical antennas, essentially generate a space wave (also called ionospheric radiation) field and are expensive and not very discreet.

Solutions have been proposed to solve these problems. The French patent application FR2965978, filed by the applicant, proposes a solution enabling the vertical dimensions of the antenna to be significantly reduced, thus enabling installation costs to be reduced and rendering the antenna more discreet. In addition, the antenna provides an improvement of surface wave propagation and a reduction of ionospheric radiation. Nevertheless, ionospheric radiation is still significant, especially for angles between ±[20°; 80°] around the normal to the ground plane whereon the antenna is arranged. This remaining ionospheric radiation can, in certain frequency bands, lead to fading phenomena, in particular when surface waves and space waves interfere, at the surface of the Earth, after propagation in different environments and via different paths.

3. AIMS OF THE INVENTION

The invention aims to alleviate at least some of the disadvantages of known antennas.

In particular, the invention aims to provide, in at least one embodiment of the invention, an antenna whose preferential radiation is surface wave radiation.

The invention also aims to provide, in at least one embodiment, an antenna whose ionospheric radiation is decreased.

The invention also aims to provide, in at least one embodiment of the invention, an antenna that is simple to carry out.

The invention also aims to provide, in at least one embodiment, a discreet antenna and whose vertical dimensions are small.

The invention also aims to provide, in at least one embodiment, an antenna whose bandwidth can be easily modified.

The invention also aims to provide an array of surface wave antennas.

The invention also aims to provide a use of an antenna or of an antenna array for surface wave radiation.

4. PRESENTATION OF THE INVENTION

To this end, the invention relates to an antenna designed to emit and/or receive surface waves with a decametric, hectometric or kilometric central wavelength $\lambda_0$, characterised in that it comprises:

- at least one horizontal wire aerial element of between $0.5\lambda_0$ and $\lambda_0$ in length,
- at least three vertical wire aerial elements of the same length between $0.03\lambda_0$ et $0.1\lambda_0$, arranged in a same plane and each comprising an upper end and a lower end, said upper ends being connected to the horizontal wire aerial element, said lower ends being designed to be connected to a conducting medium having a substantially horizontal surface, and in that the upper ends of at least two vertical wire aerial elements are respectively connected to a first end and to a second end of the horizontal wire aerial element, and the upper end of a vertical wire aerial element, called central element, is connected to the horizontal wire aerial element in its centre, the central element also being connected to a device for feeding the antenna.

An antenna according to the invention therefore allows the emission/reception of vertically polarised directional surface waves and a reduction of ionospheric radiation compared with conventional antennas thanks to the use of a particular form of antenna, in such a way as to emit/receive surface waves. The connection of the antenna to a conducting medium, such as a terrestrial or aquatic medium, enables the radiation of surface waves propagating along this medium. In particular, the surface wave is designed to follow the earth curvature, thus enabling propagation over long distances.

In addition, the antenna has a height equal to the length of the vertical wire aerial elements, in other words a height of between $0.03\lambda_0$ et $0.1\lambda_0$, which makes it an electrically short antenna in the vertical plane, and having reduced vertical dimensions. Such an antenna is therefore discreet. In addition, it is less sensitive to wind, blasts, lightning, earthquakes, etc.

The central wavelength $\lambda_0$ corresponds to the wavelength associated with the operating frequency if the antenna radiates in a single frequency, or, if the antenna radiates in a frequency band, to the wavelength associated with the centre frequency of said frequency band.

The aerial elements form two symmetrical loops relative to the central element, enabling the radiation of directional surface waves.

Advantageously, an antenna according to the invention comprises at least two horizontal wire aerial elements each connected to at least two vertical wire aerial elements and to the central element.

Advantageously and according to the invention, at least two horizontal wire aerial elements are of the same length, arranged side by side and at an equal distance from the conducting medium.

The horizontal wire aerial elements side by side make it possible to increase the width of the antenna and thus increase the radiation frequency band of the antenna.

Advantageously and according to the invention, at least two horizontal wire elements are parallel, of different lengths, arranged one above the other at a different distance from the conducting medium.

The horizontal wire aerial elements, one above the other and of different lengths, enable radiation from the antenna at an additional centre frequency, by duplicating the elements of the antenna at suitable lengths so as to form a dual-resonance antenna.

Advantageously, an antenna according to the invention comprises lumped elements of the resistive, capacitive and/or inductive type designed to form current traps on the antenna.

According to this aspect of the invention, the lumped elements are used to form current traps on the antenna, that is to say to form circuits that are open at certain frequencies and closed at other frequencies, so as to create an antenna with multiple resonances.

The invention also relates to an antenna array characterised in that it comprises at least two antennas according to the invention, said antennas forming a line of antennas so that the horizontal wire aerial elements of said antennas are perpendicular to a same plane of alignment.

The array formed is a linear antenna array, wherein all antennas are aligned.

The formation of an antenna array from the antennas according to the invention makes it possible to accentuate the advantages provided by these antennas: in particular, the radiation of the antenna array has better directivity, the gain of the surface waves is improved and the ionospheric radiation is significantly reduced. The antenna array has the same vertical dimensions as the antenna according to the invention for improved performance. The antenna according to the invention is attractive for situations where it is necessary to occupy a small surface area.

Advantageously, an antenna array according to the invention comprises at least two lines of antennas whose planes of alignment are parallel, each horizontal aerial element of an antenna from a line being aligned with a horizontal aerial element of an antenna from at least one other line.

The array formed is a planar antenna array, comprising a plurality of linear arrays.

The invention also relates to a use of at least one antenna according to the invention, said antenna being connected to a terrestrial or aquatic conducting medium, for the emission/reception of surface waves so that said surface waves propagate along said medium.

The invention also relates to a use of at least one antenna array according to the invention, each antenna from said antenna array being connected to a terrestrial or aquatic conducting medium, for the emission/reception of surface waves so that said surface waves propagate along said medium.

The use of an antenna according to the invention or of an antenna array according to the invention on a terrestrial or aquatic conducting medium such as land, sea, a lake or a salt marsh, enables the radiation of surface waves along said medium. The conducting medium has large dimensions relative to the antenna or to the antenna array (said large dimensions are considered as infinite relative to the dimensions of the antenna or of the antenna array) and thus enables the propagation of surface waves over long distances. In addition, the large dimensions of the conducting medium enable ionospheric radiation to be reduced.

The invention also relates to an antenna, an antenna array and a use of an antenna or of an antenna array characterised by a combination of all or some of the characteristics mentioned above or below.

5. LIST OF FIGURES

Figure 2:
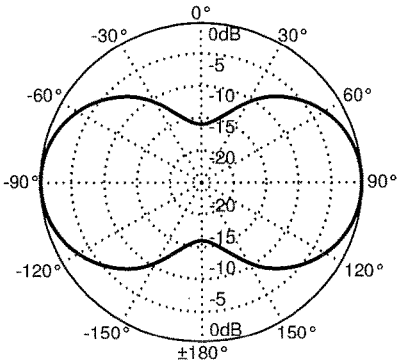
Figure 3:
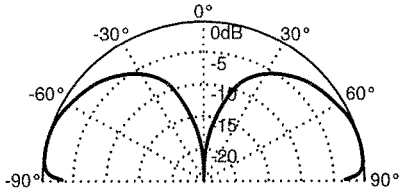
Figure 4:
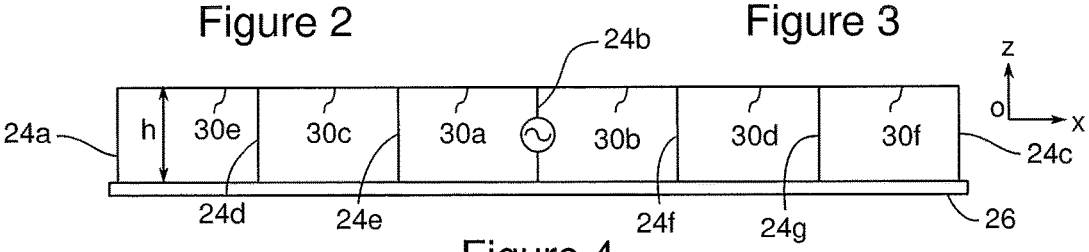
Figure 5:
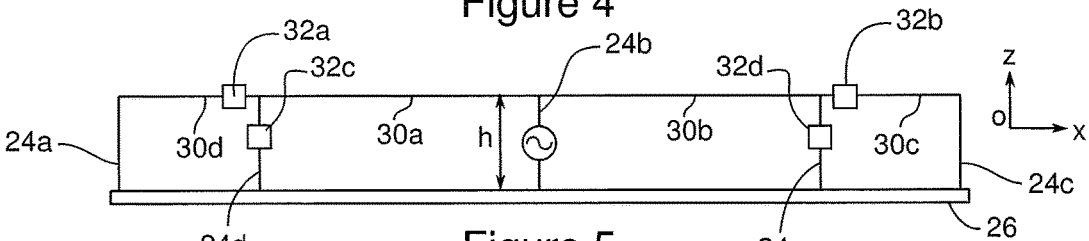
Figure 6:
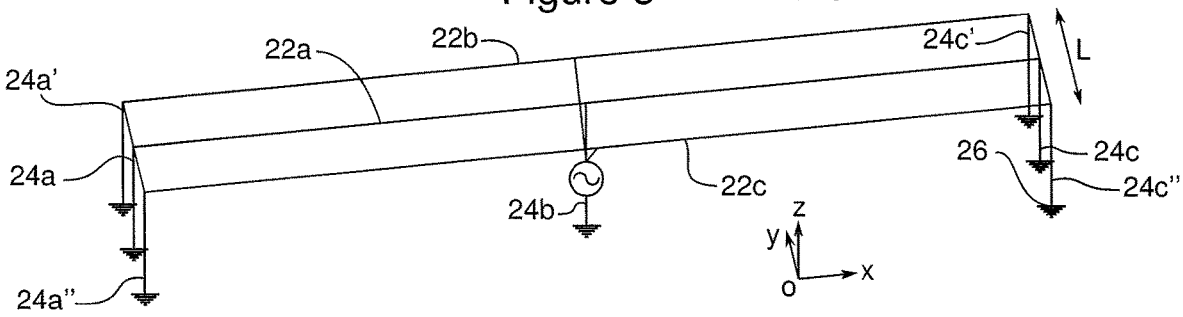
Figure 7:
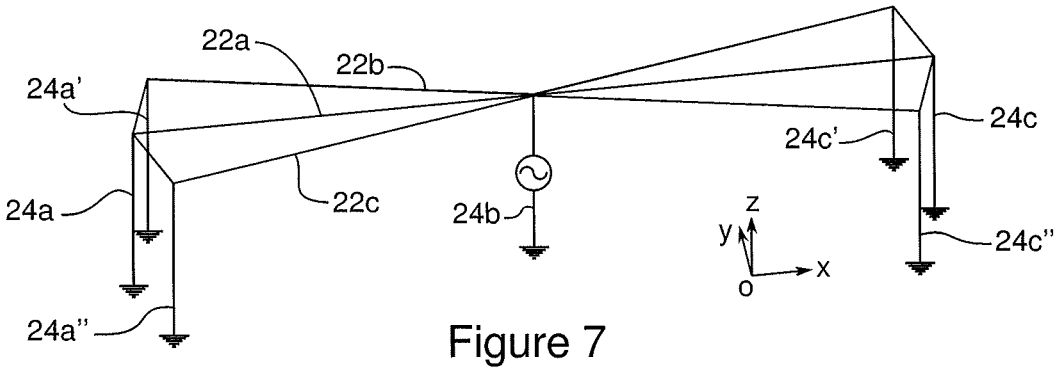
Figure 8:
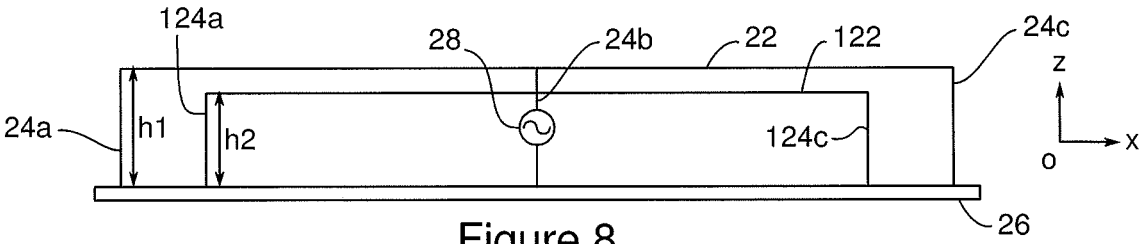
Figure 9:
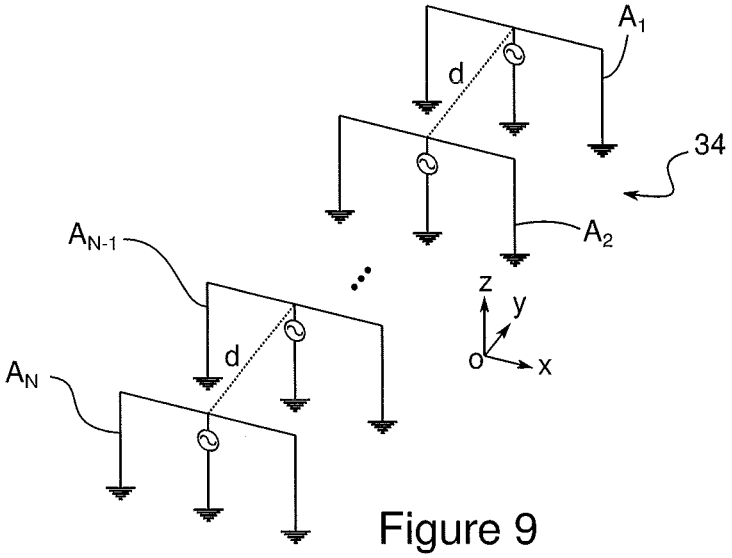
Figure 10:
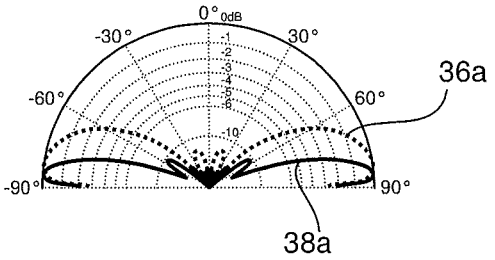
Figure 11:
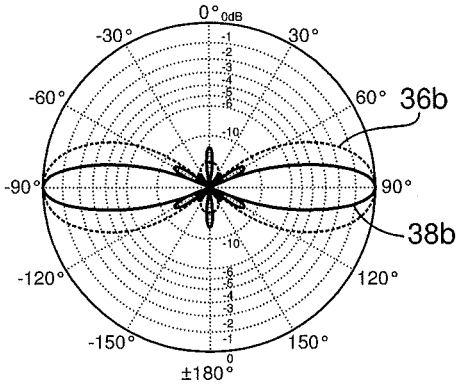
Figure 12:
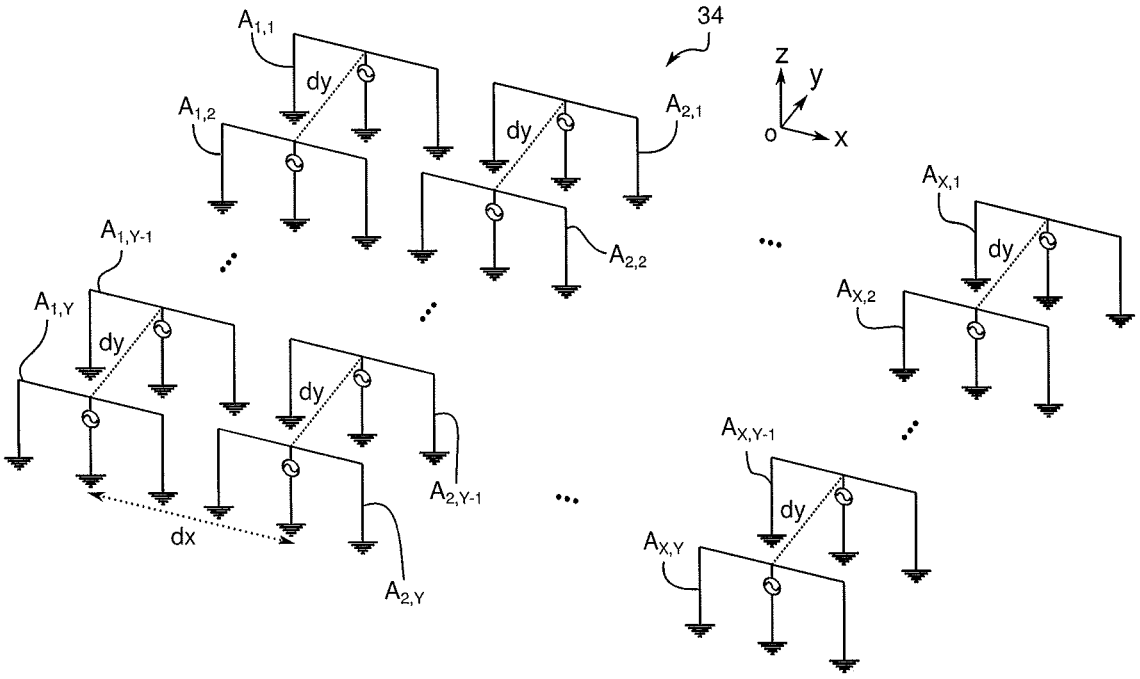
Figure 13:
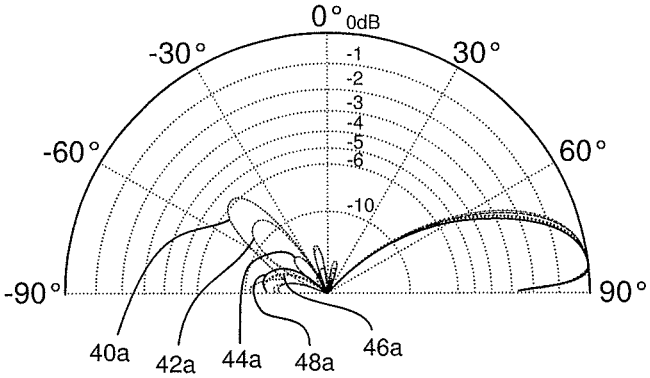
Figure 14:
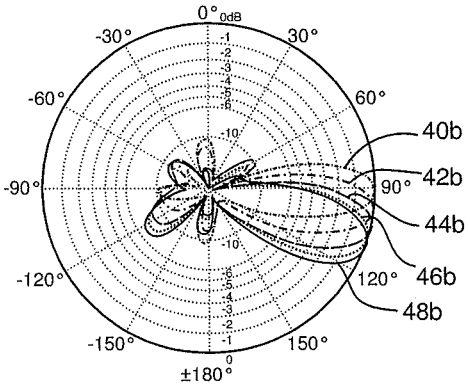

Other aims, characteristics and advantages of the invention will appear on reading the following description provided solely by way of non-limiting example and which refers to the appended figures wherein:

FIG. 1 is a schematic view along an xOz plane of an antenna according to a first embodiment of the invention, FIG. 2 is a radiation pattern along the xOy plane of the antenna according to the first embodiment of the invention, FIG. 3 is a radiation pattern along the yOz plane of the antenna according to the first embodiment of the invention, FIG. 4 is a schematic view along an xOz plane of an antenna according to a second embodiment of the invention, FIG. 5 is a schematic view along an xOz plane of an antenna according to a third embodiment of the invention, FIG. 6 is a schematic perspective view of an antenna according to a fourth embodiment of the invention, FIG. 7 is a schematic perspective view of an antenna according to a fifth embodiment of the invention, FIG. 8 is a schematic view along an xOz plane of an antenna according to a sixth embodiment of the invention, FIG. 9 is a schematic perspective view of an antenna array according to a first embodiment of the invention, FIG. 10 is a radiation pattern along the yOz plane of the antenna array according to the first embodiment of the invention, FIG. 11 is a radiation pattern along the xOy plane of the antenna array according to the first embodiment of the invention, FIG. 12 is a schematic perspective view of an antenna array according to a second embodiment of the invention, FIG. 13 is a radiation pattern along the yOz plane of the antenna array according to the second embodiment of the invention, FIG. 14 is a radiation pattern along the xOy plane of the antenna array according to the second embodiment of the invention.

6. DETAILED DESCRIPTION OF AN EMBODIMENT OF THE INVENTION

The following embodiments are examples. Although the description refers to one or more embodiments, this does not necessarily mean that each reference relates to the same embodiment, or that the characteristics apply only to a single embodiment. Simple characteristics of different embodiments may also be combined to provide other embodiments. In the figures, scales and proportions are not strictly adhered to and this is for the purposes of illustration and clarity.

An orthogonal Oxyz coordinate system is used on each figure representing the antennas or antenna arrays depending on the different embodiments of the invention.

The notions of "horizontal" and "vertical" are used in relation to an antenna once installed, in an operational situation, as represented in FIG. 1. In addition, an element is horizontal if its main direction is parallel to the xOy plane and is vertical if its main direction is parallel to the Oz axis.

FIG. 1 is a schematic representation of an antenna 20 along an xOz plane according to a first embodiment of the invention.

The antenna 20 comprises a horizontal wire aerial element 22, called horizontal element 22, connected to three vertical wire aerial elements 24*a*, 24*b*, 24*c*, called vertical elements 24*a*, 24*b*, 24*c*. The vertical elements 24*a*, 24*b*, 24*c* each comprise an upper end connected to the horizontal element 22, and a lower end connected to a conducting medium 26. According to the embodiments, the aerial elements may be made of tubes or of multi- or single-stranded wires, preferably with a small cross-section.

The conducting medium 26 is an imperfect conducting medium designed for the propagation of surface waves. The conducting medium 26 may be a medium with high electrical conductivity such as the sea, a salt marsh, a salt lake, etc., or a medium with lower conductivity such as land, sand, etc. In the event that the conducting medium 26 has low conductivity, typically less than 1 S/m, a ground plane is integrated into the conducting medium 26 and is connected to the vertical elements 24. The ground plane can take different shapes (circle, rectangle, irregular polygon, etc.) and covers a surface that is substantially equal to or greater than the projection of the antenna on the surface of the conducting medium.

In this embodiment, two vertical elements 24*a* and 24*c* are respectively connected to a first end and to a second end of the horizontal element 22. A third vertical element 24*b*, called central vertical element 24*b*, is connected to the horizontal element 22 in its centre. In addition, the central vertical element 24*b* is connected to a device 28 for feeding the antenna.

The horizontal element 22 has a length of between $0.5\lambda_0$ and $\lambda_0$, which corresponds to the length of the antenna, and the vertical elements 24*a*, 24*b*, 24*c* have a length of between $0.03\lambda_0$ and $0.1\lambda_0$, which corresponds to a height h of the antenna relative to the conducting medium. The antenna 20 is therefore electrically short in the vertical plane and has reduced vertical dimensions.

Due to the length and the particular arrangement of the horizontal element 22 and vertical elements 24*a*, 24*b*, 24*c*, and due to the use of the antenna on a terrestrial or aquatic conducting medium, preferably with large dimensions such as land or sea (which can be considered as infinite dimensions relative to the dimensions of the antenna), the antenna is particularly suited to emitting and/or receiving directional surface waves that propagate along the conducting medium, thus enabling the propagation of long-distance waves by following the earth curvature. This propagation is encouraged by the discontinuity between the air in which the surface waves propagate and the conducting medium.

FIGS. 2 and 3 show radiation patterns along the xOy plane and along the yOz plane of the antenna respectively according to the first embodiment of the invention, wherein the horizontal element has a length of $0.7\lambda_0$ and the vertical elements have a length of $0.06\lambda_0$. On both diagrams, the lines corresponding to the angles −90° and 90° represent the Oy axis.

The antenna thus provides directional radiation in a direction perpendicular to the horizontal element 22 (i.e. along the Oy axis), and having a significant gain for a surface wave radiation close to the conducting medium, i.e. for zenith angles close to −90° and 90°.

The embodiments described below are all based on this first embodiment to which further modifications are made.

FIG. 4 is a schematic representation of an antenna 20 along the xOz plane according to a second embodiment of the invention.

The antenna includes additional vertical elements 24*d*, 24*e*, 24*f*, 24*g*, making it possible to create additional resonance loops of varying sizes. These additional vertical elements are arranged between the vertical elements described above and are connected to the horizontal element 22 so as to form a plurality of sections 30*a*, 30*b*, 30*c*, 30*d*, 30*e*, 30*f* of different lengths on the horizontal element 22. For example, two first sections 30*a* and 30*b* have a length of the order of $0.175\lambda_0$, two second sections 30*c* and 30*d* have a length of the order of $0.35\lambda_0$, and two third sections 30*e* and 30*f* have a length of the order of $0.5\lambda_0$. These sections 30*a*, 30*b*, 30*c*, 30*d*, 30*e*, 30*f* enable multiple resonance from the antenna at several frequencies.

FIG. 5 is a schematic representation of an antenna 20 along the xOz plane according to a third embodiment of the invention.

The antenna comprises two additional vertical elements 24*d*, 24*e* as in the second embodiment of the invention, as well as lumped elements, here two first lumped elements 32*a* and 32*b* arranged on the horizontal element 22, and two second lumped elements 32*c* and 32*d* each arranged on one of two additional elements 24*d*, 24*e*.

The lumped elements may be resistive, capacitive (capacitors) or inductive (inductors) elements. These lumped elements are often called "load" in English. The lumped elements can make it possible to reproduce the RLC resonance of the aerial elements with a reduced physical length (or overall dimensions) but an equivalent electrical length.

The lumped elements can also make it possible to create, on the aerial elements, circuits that are open (or high impedance) at certain operating frequencies and closed at other operating frequencies, thus enabling a variation of the resonance of the aerial elements depending on the operating frequency. These lumped elements thus create multiple resonances by means of current traps.

FIG. 6 is a schematic perspective representation of an antenna 20 according to a fourth embodiment of the invention.

The antenna comprises a plurality of horizontal elements, here three horizontal elements 22*a*, 22*b*, 22*c*, parallel to each other. Each horizontal element has each of its ends connected to a vertical element, and the three horizontal elements are connected in their centre to a single vertical element. Conducting wires connect the first ends of the horizontal elements to one other and the second ends of the horizontal elements to one other.

The presence of a plurality of horizontal elements increases the width Lr of the antenna, thus increasing the bandwidth of the antenna, in particular by improving the standing wave ratio (SWR).

FIG. 7 is a schematic perspective representation of an antenna 20 according to a fifth embodiment of the invention. The antenna comprises a plurality of horizontal elements, here three horizontal elements 22*a*, 22*b*, 22*c*, secant in their centre. As for the fourth embodiment, the bandwidth of the antenna is increased in particular by improving the SWR. In addition, the connection of the three horizontal elements in their middle makes it possible to decrease the reactive parts of the impedance of the antenna.

FIG. 8 is a schematic representation of an antenna 20 along the xOz plane according to a sixth embodiment of the invention.

The antenna 20 comprises, in addition to the horizontal element 22 and the three vertical elements 24*a*, 24*b*, 24*c* of the first embodiment, a second horizontal element 122 and two second vertical elements 124*a*, 124*c* of reduced size, making it possible to form the equivalent of a second antenna resonating at a frequency $f_{bis}$ different from $f_0$ (the frequency $f_{bis}$ being associated with a wavelength bis). The horizontal element 122 has a length of between $0.5\lambda_{bis}$ and $\lambda_{bis}$ and the two vertical elements 124*a*, 124*c* have a length of between $0.03\lambda_{bis}$ and $0.1\lambda_{bis}$. The second horizontal element 122 is connected in its centre to the central vertical element 24*b*, thus providing a common feed via the feeding device 28. The antenna 20 is thus a dual resonance antenna by duplicating the basic structure of the antenna with different dimensions, set at two different frequencies $f_0$ and $f_{bis}$.

FIG. 9 is a schematic perspective representation of an antenna array 34 according to a first embodiment of the invention.

The antenna array is composed of a plurality of antennas according to one of the embodiments of the invention, for example here N antennas labelled $A_1$, $A_2$, etc., $A_{N-1}$, $A_N$ according to the first embodiment of the invention. The antennas are aligned so that all the horizontal elements are perpendicular to a same plane of alignment. The antennas thus aligned form a line of antennas, also called a linear antenna array. The antennas are fed by equi-amplitude and equi-phase sources. In this embodiment, each antenna is spaced at a distance d equal to $0.93\lambda_0$ from the other antennas. In order to make the meaning of the figure clear, the antennas are represented with different length-width proportions from the embodiments described above, but their dimensions are between $0.5\lambda_0$ and $\lambda_0$ for length and $0.03\lambda_0$ and $0.1\lambda_0$ for height, as previously described.

FIGS. 10 and 11 represent radiation patterns along the yOz plane and along the xOy plane respectively of the antenna array 34 according to the first embodiment of the invention. On both diagrams, the lines corresponding to the −90° and 90° angles represent the Oy axis. The curves 36*a* and 36*b* represent the radiation of an antenna array comprising N=2 antennas and the curves 38*a* and 38*b* represent the radiation of an antenna array comprising N=6 antennas.

The surface wave radiation of the antenna described above is thus improved through the networking of several of these antennas in order to form an antenna array. The radiation along the yOz plane of the antenna array is very close to the −90° and 90° angles which correspond to surface waves very close to the surface of the conducting medium, and the ionospheric radiation is very significantly reduced. This improvement of performance can be seen as soon as two antennas are networked, and is accentuated by adding more antennas, in particular with six antennas. The surface wave ratio on ionospheric waves (sky waves) can be further optimised by using suitable amplitude weighting and/or phase weighting.

In addition, the radiation along the xOy plane shows that the directivity of the antenna is also greatly improved in a direction perpendicular to the horizontal elements of the antennas.

FIG. 12 is a schematic perspective representation of an antenna array 34 according to a second embodiment of the invention.

The antenna array 34 is composed of a plurality of antenna lines as described with reference to the first embodiment of the antenna array. The antenna array thus forms a planar antenna array, along two dimensions. The array also comprises X lines of Y antennas labelled $A_{1,1}$, $A_{2,1}$, etc., $A_{X,1}$, $A_{1,2}$, $A_{2,2}$, etc., $A_{X,2}$, etc., $A_{1,Y-1}$, $A_{2,Y-1}$, $A_{X,Y-1}$, $A_{1,Y}$, $A_{2,Y}$, $A_{X,Y}$. The distance $d_X$ between two lines is less than $\lambda_0$. If the distance $d_x$ is smaller than the length of the horizontal aerial element of the antenna, the antennas from different lines are arranged so that their horizontal aerial elements are not in contact. For example, two antennas located side by side (as for example $A_{1,1}$ and $A_{2,1}$) are shifted on the Oy axis so as not to be in contact.

This configuration makes it possible, thanks to phase shifts applied to the antennas, to modify the direction of radiation of the antenna array. In particular, the lines have a phase shift $\Delta\varphi$ relative to one another. For example, with the phase shift $\Delta\varphi$ of the antenna $A_{1,1}$ from the first line comprising the antennas $A_{1,1}$, $A_{1,2}$, etc., $A_{1,Y-1}$, $A_{1,Y}$, the antenna $A_{2,1}$ from the second line comprising the antennas $A_{2,1}$, $A_{2,2}$, etc., $A_{2,Y-1}$, $A_{2,Y}$, has a phase shift equal to $2\Delta\varphi$ and the antenna $A_{X,1}$ from the Xth line comprising the antennas $A_{X,1}$, $A_{X,2}$, etc., $A_{X,Y-1}$, $A_{X,Y}$ has a phase shift equal to $X\Delta\varphi$.

In addition, antennas of a same line may have different phases: for example, the two antennas $A_{1,1}$ and $A_{1,2}$ represented form a sub-array $R_1$ fed with the same amplitude and the same phase, and the two antennas $A_{1,Y-1}$ and $A_{1,Y}$ represented form a sub-array $R_2$ fed with the same amplitude and the same phase but with a phase shift of 90° relative to the antennas of the sub-array $R_1$. This shifting in each line makes it possible to obtain unidirectional radiation.

FIGS. 13 and 14 represent radiation patterns along the yOz plane and along the xOy plane respectively of the antenna array according to the second embodiment of the invention. On both diagrams, the lines corresponding to the −90° and 90° angles represent the Oy axis. The antenna array comprises three lines of four antennas, i.e. twelve antennas. The central wavelength $\lambda_0$ is equal to 28 m, the horizontal aerial elements of the antennas have a length of 18 m (i.e. around $0.64\lambda_0$), the antennas have a height of 1.8 m (i.e. around $0.064\lambda_0$). The distance $d_x$ between two lines is equal to 10 m. To prevent antennas from two lines from being in contact, they are shifted by a distance of 2 m along the Oy axis. The distance $d_y$ between two antennas from a same line is equal to 20.2 m for antennas in phase (from a same sub-array), and equal to 27 m for antennas out of phase by 90° (from a different sub-array).

The curves represent radiation depending on several values of $\Delta\varphi$, respectively 0° for the curves 40*a* and 40*b*, 22.5° for the curves 42*a* and 42*b*, 44° for the curves 44*a* and 44*b*, 65° for the curves 46*a* and 46*b*, 85° for the curves 48*a* and 48*b*.

The radiation along xOz is relatively identical for all the $\Delta\varphi$ values. On the other hand, the radiation in the xOy plane has a different form depending on the value of $\Delta\varphi$, and in particular the preferential direction of radiation of the antenna array is variable. The antenna array can thus be reconfigured in order to modify its radiation without the need to perform physical intervention on the antenna arrangement, but only by modifying the $\Delta\varphi$ phase shift value of each line relative to the other lines. In this embodiment, the antenna array can thus be reconfigured over an angular range of 60°, as can be seen in FIG. 11: only configurations between 90° and 120° are represented, configurations with negative values of $\Delta\varphi$ can be used to obtain symmetrical radiation relative to the Oy axis, the angular range then being between 60° and 120°. In addition, the amplitudes of the antenna feed system can be weighted to optimise radiation patterns, in particular so as to prevent the appearance of significant side lobes in case of severe misalignment of the antennas.

The invention is not limited to the embodiments described. In particular, the characteristics of the different embodiments of the antennas can be combined, and the antenna arrays can be formed of antennas according to any one of the antenna embodiments.

The invention claimed is:

1. Antenna designed to emit and/or receive surface waves with a decametric, hectometric or kilometric central wavelength $\lambda_0$, comprising:

at least one horizontal wire aerial element of between 0.5 $\lambda_0$ and $\lambda_0$ in length, an imperfect conducting medium comprising a terrestrial or an aquatic medium and having a substantially horizontal surface;

at least three vertical wire aerial elements of the same length between 0.03 $\lambda_0$ and 0.1 $\lambda 0$, arranged in a same plane and each comprising an upper end and a lower end, said upper ends being connected to the horizontal wire aerial element, said lower ends being connected to said imperfect conducting medium;

wherein:

the upper ends of at least two vertical wire aerial elements are respectively connected to a first end and to a second end of the horizontal wire aerial element, and the upper end of a vertical wire aerial element, called central element, is connected to the horizontal wire aerial element in its centre, the central element also being connected to a device for feeding the antenna.

2. Antenna according to claim 1, comprising at least two horizontal wire aerial elements each connected to at least two vertical wire aerial elements and to the central element.

3. Antenna according to claim 2, wherein at least two horizontal wire aerial elements are of the same length, arranged side by side and at a same distance from the conducting medium.

4. Antenna according to claim 2, wherein at least two horizontal wire aerial elements are parallel, of different lengths, arranged one above the other at a different distance from the conducting medium.

5. Antenna according to claim 1, comprising lumped elements of the resistive, capacitive and/or inductive type designed to form current traps on the antenna.

6. Antenna array, comprising at least two antennas according to claim 1, said antennas forming a line of antennas so that at least one horizontal wire aerial element of each antenna is perpendicular to a plane of alignment.

7. Antenna array according to claim 6, comprising at least two lines of antennas whose alignment planes are parallel, one horizontal aerial element of each antenna from a line being aligned with a horizontal aerial element of an antenna from at least one other line.

8. Method of emitting/receiving surface waves so said surface waves propagate along a medium, comprising providing at least one antenna array according to claim 6, wherein each antenna of said antenna array is connected to a terrestrial or aquatic conducting medium.

9. Method of emitting/receiving surface waves so said surface waves propagate along a medium, comprising providing at least one antenna according to claim 1, wherein said antenna is connected to a terrestrial or aquatic conducting medium.

10. Antenna designed to emit and/or receive surface waves with a decametric, hectometric or kilometric central wavelength $\lambda 0$, comprising:

at least one horizontal wire aerial element of between 0.5 $\lambda 0$ and $\lambda 0$ in length, at least three vertical wire aerial elements of the same length between 0.03 $\lambda 0$ and 0.1 $\lambda 0$, arranged in a same plane and each comprising an upper end and a lower end, said upper ends being connected to the horizontal wire aerial element, said lower ends being connected to a conducting medium having a substantially horizontal surface, wherein the upper ends of at least two vertical wire aerial elements are respectively connected to a first end and to a second end of the horizontal wire aerial element, wherein the upper end of a vertical wire aerial element, called central element, is connected to the horizontal wire aerial element in its centre, the central element also being connected to a device for feeding the antenna, wherein the at least one horizontal wire aerial elements comprises at least two horizontal wire aerial elements each connected to at least two vertical wire aerial elements and to the central element, and wherein the at least two horizontal wire aerial elements are of the same length, arranged side by side and at a same distance from the conducting medium.

11. Antenna array, comprising at least two antennas according to claim 10, said antennas forming a line of antennas so that at least one horizontal wire aerial element of each antenna is perpendicular to a plane of alignment.

12. Antenna designed to emit and/or receive surface waves with a decametric, hectometric or kilometric central wavelength $\lambda 0$, comprising:

at least one horizontal wire aerial element of between 0.5 $\lambda 0$ and $\lambda 0$ in length, at least three vertical wire aerial elements of the same length between 0.03 $\lambda 0$ and 0.1 $\lambda 0$, arranged in a same plane and each comprising an upper end and a lower end, said upper ends being connected to the horizontal wire aerial element, said lower ends being connected to a conducting medium having a substantially horizontal surface, and lumped elements of the resistive, capacitive and/or inductive type designed to form current traps on the antenna, wherein the upper ends of at least two vertical wire aerial elements are respectively connected to a first end and to a second end of the horizontal wire aerial element, wherein the upper end of a vertical wire aerial element, called central element, is connected to the horizontal wire aerial element in its centre, the central element also being connected to a device for feeding the antenna.

13. Antenna array, comprising at least two antennas according to claim 12, said antennas forming a line of antennas so that at least one horizontal wire aerial element of each antenna is perpendicular to a plane of alignment.

* * * * *